US005165813A

United States Patent [19]

Kageyama et al.

[11] Patent Number: 5,165,813

[45] Date of Patent: Nov. 24, 1992

[54] CONTAINER WITH SNAP-IN CHUCK AND CHUCK RING

[75] Inventors: Shuhei Kageyama; Tadayoshi Ebinuma; Yoshio Noguchi; Yoshihide Mitsuya, all of Kawagoe, Japan

[73] Assignee: Kotobuki & Co., Ltd., Kyoto, Japan

[21] Appl. No.: 815,406

[22] Filed: Dec. 31, 1991

[30] Foreign Application Priority Data

Jul. 23, 1991 [JP] Japan ..... 3-57433[U]

[51] Int. Cl.[5] ..... B43K 21/22

[52] U.S. Cl. ..... 401/65; 401/94

[58] Field of Search ..... 401/93, 94, 65, 67

[56] References Cited

U.S. PATENT DOCUMENTS 2,509,849 5/1990 von Allmen ..... 401/67
3,854,825 12/1974 Girella ..... 401/65 X
4,714,365 12/1987 Kageyama et al. ..... 401/94 X

FOREIGN PATENT DOCUMENTS 732214 1/1943 Fed. Rep. of Germany ..... 401/94
275199 11/1989 Japan ..... 401/65

*Primary Examiner*—Steven A. Bratlie
*Attorney, Agent, or Firm*—David O'Reilly

[57] ABSTRACT

A container for extending a stick-shaped material comprises a tubular body and a chuck formed on the tubular body inserted into a chuck ring. The tubular body and the chuck ring are provided with first and second deflectable projecting parts respectively, while a head member is provided with first and second retaining holes the first deflectable projections of the tubular body engage the first retaining holes, while the second deflectable projecting parts of the chuck ring engage the second retaining holes of the head member. A resilient elastic body is mounted between the end of the head member and an elastic body bearing formed on the tubular body. A stick-shaped material such as a stick-shaped eraser is held in the head member and the chuck. The tubular member, the chuck ring, the stick-shaped material and the elastic body are assembled as a unit with the head member. Therefore, the number of parts is reduced and assembly and disassembly becomes relatively easy.

10 Claims, 2 Drawing Sheets

CONTAINER WITH SNAP-IN CHUCK AND CHUCK RING

BACKGROUND OF THE INVENTION

1. Field of the Invention

The present invention relates to container for extending stick-shaped material in which stick-shaped material such as a stick-shaped eraser, crayon, pastel, lead or the like out of a head member.

2. Description of the Prior Art

A conventional container for extending a stick-shaped material comprises an inner sleeve, a chuck, and a chuck ring, wherein the chuck is widened or fastened by moving the chuck forward in the chuck ring against a spring or by moving the chuck backward by means of the force of the spring by which a stick-shaped material is extended by a given length from the head member.

In the above-mentioned conventional container, there are problems of the head member becoming detached from the outer sleeve, the chuck ring, the spring, the inner sleeve with the chuck, and the like becoming detached from each other, and that therefore the number of parts is increased and the conventional container is not easy to assemble and disassemble.

BRIEF SUMMARY OF THE INVENTION

It is an object of the invention to provide for extending a stick-shaped material container in which the number of parts are reduced, and the container for extending a stick-shaped material is easy to assemble and disassemble.

The above-mentioned object is attained, according to the present invention, by a container for extending stick-shaped material container assembly comprised of a tubular body, a chuck provided on the tubular body, a chuck ring for opening or closing the chuck being mounted the chuck. A head member, and an elastic body provided between the head member and an elastic body bearing are formed on the tubular body. First projecting parts are formed on the tubular body, second projecting parts are formed on the chuck ring, and first and second retaining holes are formed in the head member. The first and second retaining holes correspond to the first projecting parts of the tubular body and the second projecting parts of the chuck ring, respectively. Thus the first projecting parts of the tubular body fit into and are retained in the first retaining hole of the head member, while the second projecting parts of the chuck ring fit into and are retained in the second retaining hole, whereby a stick-shaped material is held in the head member and the chuck.

In the above-mentioned container for extending a stick-shaped material, when the tubular body is pushed against the head member, the chuck moves forward against the elastic body or moves backward by means of an elastic force thereof causing the stick-shaped material to be extended out of the head member by a given length.

Since the tubular body, the chuck, the chuck ring, the elastic body, the stick-shaped material, and the head member are held together as a unit by engaging the first projecting parts of the tubular body and the second projecting parts of the chuck ring with the first and the second retaining holes of the head member, respectively, the number of parts is reduced and therefore assembly and disassembly of a container for extending a stick-shaped material becomes relatively easy.

DETAILED DESCRIPTION

Figure 1:
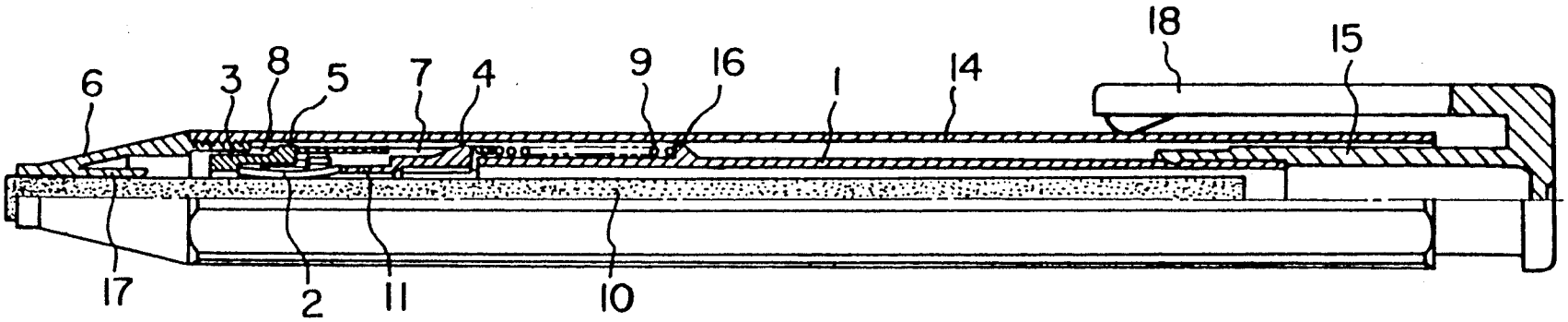
FIG. 1 illustrates in elevation partly in section an embodiment of a container for extending stick-shaped material according to the present invention.
Figure 2:
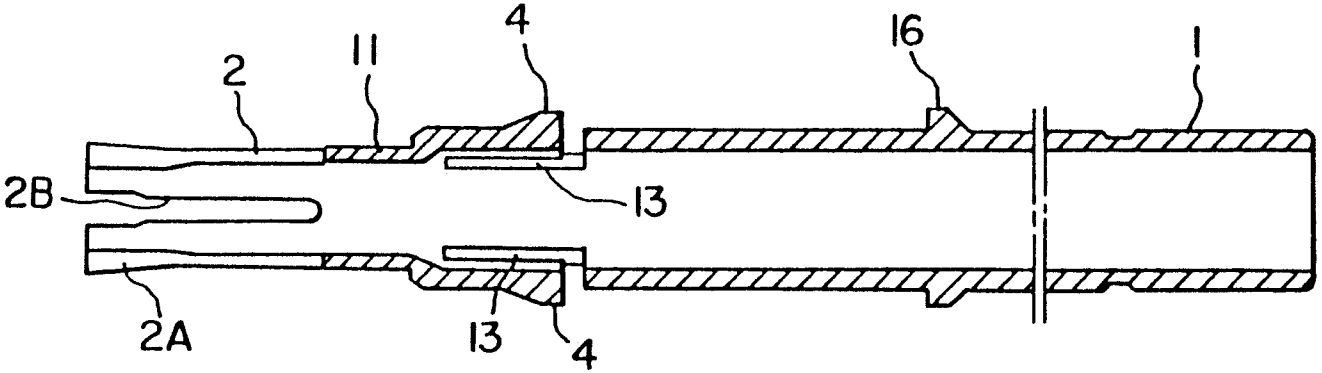
FIG. 2 is a sectional view of a tubular body of the present invention.
Figure 3:
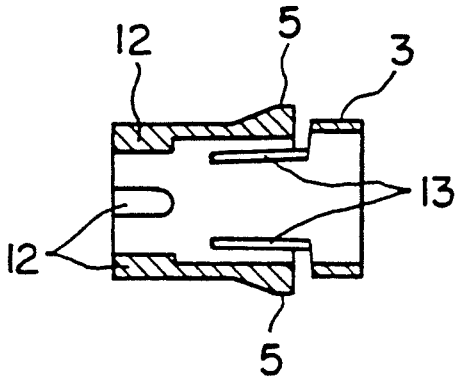
FIG. 3 is a sectional view of a chuck ring of the present invention.

Referring to FIGS. 1 to 3, a container for extending stick-shaped material according to the present invention comprises tubular body 1, and chuck 2. Tubular body 1 has smaller diameter portion 11 which has an outside diameter smaller than the outside diameter of tubular body 1, and chuck 2 provided on smaller diameter portion 11. In this embodiment, chuck 2 comprises four chuck pieces 2A and widens to some degree toward the forward end(FIG. 2).

Figure 4:
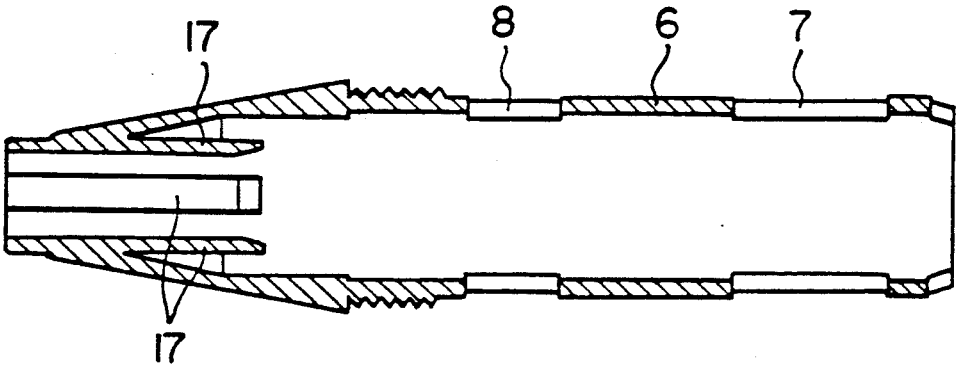
FIG. 4 is a sectional view of a head member of the present invention.

Chuck 2 is inserted into chuck ring 3 having an outside diameter nearly equal to the outside diameter of tubular body 1. The inside of chuck ring 3 has projections 12 for widening slots 2B between chuck pieces 2A. Projections 12 are inserted into slots 2B between chuck pieces 2A so they are spread by projections 12(FIG. 3). Sleeve 1 and chuck ring 3 have first and second projecting parts 4, 5 defined by cuts 13 in tubular body 1 and chuck ring 3, respectively(FIGS. 2 and 3). Head member 6 has first and second retaining holes 7, 8 on opposite sides that match first and second projecting parts 4, 5 (FIG. 4). Head member 6 is mounted on tubular body 1 from the end having chuck 2. Spring 9 fits between the end of head member 6 and spring bearing 16 formed on tubular body 1.

Head member 6 has on the inside thereof holding parts 17 forming a collar for holding stick-shaped material 10 such as eraser (FIG. 4). Stick-shaped eraser 10 is held in holding collar 17 of head member 6 and chuck 2. Outer sleeve 14 is detachably attached to head member 6 by means of threads, insertion, or engagement. Knocking part cap 15 is provided on the rear portion of tubular body 1. However, knocking cap 15 is not always necessary for a container for extending stick-shaped material. The rear portion of tubular body 1 may project out of outer sleeve 14 and formed the knocking part. A clip 18 is provided on knocking cap 15.

In the above-mentioned embodiment, when knocking cap 15 is pressed, chuck 2 moves forward against spring 9 or moves backward by means of the spring force thereof so that stick-shaped eraser 10 is first pushed out of chuck 2 by a given length and then is pushed out of head member 6 by a given length.

Tubular body 1, chuck 2, chuck ring 3, spring 9, and head member 6 are held together as a unit by first and second projecting parts 4, 5 of tubular body 1 and chuck ring 3 respectively fitting in retaining holes 7, 8 of head member 6. Accordingly, a container for extending stick-shaped material can be used as a product consisting of outer sleeve 14 and a unit composed of tubular body 1, chuck 2, chuck ring 3, spring 9, stick-shaped eraser 10, and head member 6. The number of parts is reduced and therefore assembly and disassembly of the container for extending stick-shaped material becomes relatively easy.

An method of assembling the container for extending a stick-shaped material according to the present invention is explained as follows.

First, from the forward end of chuck 2, spring 9 is mounted between spring bearing 16 of tubular body 1 and first projecting parts 4. Chuck ring 3 is then mounted on chuck 2 so that projections 12 of chuck ring 3 for spreading slots 2B between fit chuck pieces 2A are inserted between the four chuck pieces 2A. Thereby, chuck ring 3 and spring 9 are mounted on tubular body 1.

Then, head member 6 is threaded into outer sleeve 14, with first projecting parts 4 of tubular body 1 and second projecting parts 5 of chuck ring 3 placed on the same line. Thereby, first and second projecting parts 4, 5 deflect into head member 6 engaged and are retained in first and second retaining holes 7, 8 of head member 6, respectively while spring 9 becomes mounted between the end of head member 6 and spring bearing 16.

Stick-shaped eraser 10 is thereafter inserted into outer sleeve 1 and chuck 2 by moving forward to some extent chuck ring 3 to open chuck 2. Thereby, tubular body 1, chuck ring 3, stick-shaped eraser 10 and spring 9 are assembled as a unit with head member 6. In this state, stick-shaped eraser can be used. Finally, Outer sleeve 14 is threaded onto head member 6 and knocking cap 15 is mounted on the rear portion of tubular body 1 and assembly of the container for extending a stick-shaped material according to the present invention is finished.

Disassembling of the container for extending a stick-shaped material according to the present invention is explained as follows.

First, knocking cap 15 and outer sleeve 14 are removed from the container for extending a stick-shaped material. Thereafter, first projecting parts 4 of tubular body 1 are pressed inward so that they are released from retaining holes 7. Tubular body 1 is then separated from head member 6 by means of the spring force of spring 9 leaving spring on tubular body 1. Chuck ring 3 is then detached from head member 6 by pressing inward second projecting parts 5 of chuck ring 3 so that they are released. To release spring 9 from tubular body 1 first projecting parts 4 are again pressed inward and then spring 9 may be removed and disassembly is finished.

As in the above-mentioned, according to the present invention, since a container for extending a stick-shaped material has an assembly comprised of tubular body 1, chuck 2 provided on the forward end of tubular body 1, a chuck ring 3 for opening and closing chuck 2, said chuck ring 3 being mounted on chuck 2, head member 6, spring 9 provided between head member 6 and spring bearing 16 formed on tubular body 1, first and second projecting parts 4, 5 provided on tubular body 1 and chuck ring 3, respectively, and first and second retaining holes 7, 8 that correspond to and match first and second projecting parts 4, 5 provided in head member 6, respectively, wherein first and second projecting parts 4, 5 engage and are retained in first and second retaining holes 7, 8 respectively, and a stick-shaped material 10 is held in head member 6 and chuck 2, the number of parts is reduced and therefore assembly and disassembly of container for extending a stick-shaped material becomes relatively easy.

This invention is not to be limited by the embodiment shown in the drawings and described in the description, which is given by way of example and not of limitation, but only in accordance with the scope of the appended claims.

What is claimed is:

1. A container for extending a stick-shaped material comprising; a tubular body; said tubular body having a retaining ridge; a chuck formed on one end of said tubular body; a chuck ring mounted on said chuck for opening and closing pieces forming said chuck; a tubular head member; a resilient elastic body retained on said tubular body between the end of said head member and said retaining ridge; first deflectable projections on said tubular body formed by undercuts in the surface of said tubular body; second deflectable projections on said chuck ring; formed by undercuts in the surface of said chuck ring; first and second retaining holes in said tubular head member; said first and second projections engaging said first and second retaining holes in said head member on said tubular body; whereby a stick-shaped material may be held by said chuck inside said tubular body and said head member.

2. The container according to claim 1 wherein said chuck is formed on one end of said tubular body, said chuck having a smaller outside diameter than the rest of said tubular body; said chuck ring having projecting bosses that fit between and spread said chuck ring pieces.

3. The container according to claim 1 including an outer sleeve fitting over said tubular body and being detachably secured to said head member; knocking means at the end of said outer sleeve opposite said head member for extending a stick-shaped material held in said tubular body and said head member by said chuck.

4. The container according to claim 3 in which said knocking means comprises a rear portion of said tubular body extending beyond the end of said outer sleeve.

5. The container according to claim 3 in which said knocking means comprises a cap on the end of said outer sleeve; said cap fitting over said tubular body.

6. A container for extending a stick-shaped material having an assembly held together as a unit comprised of a tubular body, a chuck provided on said tubular body, a chuck ring for opening and closing the chuck, said chuck ring being mounted on said chuck, a head member, an elastic body provided between said head member and an elastic body bearing formed on said tubular body, first deflectable projecting parts formed on said tubular body, second deflectable projecting parts formed on said chuck ring, said first and second deflectable projecting parts being defined by cuts in the surface of said tubular body and chuck ring respectively, and first and second retaining holes formed in said head member, said first and second retaining holes corresponding to and matching said first projecting parts of said tubular body and said second projecting parts of said chuck ring, respectively, wherein said first projecting parts of said tubular body engage and are retained in said first retaining hole of said head member, while said second projecting parts of said chuck ring engage and are retained in said second retaining hole, and wherein a stick-shaped material is held in said head member and the chuck.

7. The container according to claim 6 wherein said chuck 2 is on a smaller diameter portion of said tubular body 1 and has an outside diameter smaller than the outside diameter of said tubular body 1; the inside of said chuck ring 3 having projections for spreading slots between pieces forming said chuck.

8. The container according to claim 6 wherein an outer sleeve 14 is detachably attached to said head member and the rear portion of the tubular body forms a knocking part or the rear portion of said tubular body is provided with a knocking part.

9. The container according to claim 6 in which said head member includes a holding means adjacent the head end for holding and guiding a stick-shaped material fed from said chuck out of said head member.

10. The container according to claim 9 in which said holding means comprises a holding collar formed inside said head member adjacent the head end.

* * * * *